US011306985B2

(12) United States Patent
Bubits

(10) Patent No.: US 11,306,985 B2
(45) **Date of Patent: *Apr. 19, 2022**

(54) MAGAZINE OF A PISTOL FOR CARTRIDGES WITH A CASE RIM, AND PISTOL HAVING SUCH A MAGAZINE

(71) Applicant: Taurus Holdings, Inc., Miami, FL (US)

(72) Inventor: Wilhelm Bubits, Lutzmannsburg (AT)

(73) Assignee: Taurus Holdings, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/313,094

(22) Filed: May 6, 2021

(65) Prior Publication Data

US 2021/0270554 A1 Sep. 2, 2021

Related U.S. Application Data

(63) Continuation of application No. 15/761,263, filed as application No. PCT/US2018/014970 on Jan. 24, 2018, now Pat. No. 11,035,635.

(30) Foreign Application Priority Data

Feb. 14, 2017 (AT) ..... A 50/2017

(51) Int. Cl.
*F41A 9/69* (2006.01)
*F41A 9/70* (2006.01)
(Continued)

(52) U.S. Cl.
CPC *F41A 9/69* (2013.01); *F41A 9/41* (2013.01);
*F41A 9/65* (2013.01)

(58) Field of Classification Search
CPC ..... F41A 9/65; F41A 9/69
See application file for complete search history.

(56) References Cited

U.S. PATENT DOCUMENTS 393,406 A * 11/1888 Stepski et al. ..... F41A 17/38 42/18
545,512 A * 9/1895 Lodetti ..... F41A 9/65 42/50

(Continued)

FOREIGN PATENT DOCUMENTS

DE 3305772 9/1983
EP 0608072 7/1994

*Primary Examiner* — Derrick R Morgan
(74) *Attorney, Agent, or Firm* — DeLio Peterson & Curcio LLC; Robert Curcio

(57) ABSTRACT

A magazine of a pistol for cartridges with a case rim, having a hollow magazine body for accommodating the cartridges in two vertically offset rows, a base plate, a feeder, which is guided in a displaceable manner in the magazine body, and a compression spring between the feeder and the base plate, wherein the upper end region of the magazine body forms a narrowing, in which the two rows of cartridges are guided together to form a single row. In order to ensure a reliable feed of the cartridges despite the case rim, in the longitudinal center the side walls have inwardly directed beads which run over the entire height of the side walls and merge, in the upper region, into converging guide ribs, and the feeder forms a bearing surface, which is convex in the longitudinal direction and on which a cartridge located thereon can alter its angle of inclination in relation to the horizontal.

7 Claims, 4 Drawing Sheets

(51) Int. Cl.
*F41A 9/65* (2006.01)
*F41A 9/41* (2006.01)

(56) References Cited

U.S. PATENT DOCUMENTS 980,980 A * 1/1911 Maggio ..... F41A 19/48 89/147
1,227,439 A * 5/1917 Hilgendorf ..... F41A 9/65 42/50
1,462,972 A * 7/1923 Lewis ..... F41A 9/69 42/50
1,833,862 A * 11/1931 Schmeisser ..... F41A 9/69 42/50
2,217,848 A * 10/1940 Schillstrom ..... F41A 9/69 42/50
2,365,392 A * 12/1944 Cooley ..... F41A 9/69 89/34
2,712,705 A * 7/1955 St Amant ..... F42B 39/24 42/50
2,777,235 A * 1/1957 Hopkins ..... F41A 9/69 42/50
2,801,485 A * 8/1957 Marsh ..... F41A 9/66 42/50
2,903,809 A * 9/1959 Stoner ..... F41A 9/65 42/50
3,399,480 A * 9/1968 Rowe, Jr. ..... F41A 9/69 42/50
3,440,751 A * 4/1969 Fremont ..... F41A 9/69 42/50
3,516,189 A * 6/1970 Badali ..... F41A 9/70 42/50
3,619,929 A * 11/1971 Fremont ..... F41A 9/69 42/50
3,672,089 A * 6/1972 Silsby ..... F41A 9/69 42/50
3,726,038 A * 4/1973 Bredbury ..... F41A 9/70 42/50
3,952,441 A * 4/1976 Tant ..... F41A 9/69 42/50
4,356,653 A * 11/1982 Swieskowski ..... F41A 9/70 42/50
4,413,437 A * 11/1983 Anderson ..... F41A 9/65 42/50
4,472,900 A * 9/1984 Howard ..... F41A 9/69 42/50
4,539,889 A * 9/1985 Glock ..... F41A 5/04 89/147
4,589,218 A * 5/1986 Teppa ..... F41A 9/69 42/50
4,672,760 A * 6/1987 Chesnut ..... F41A 9/69 42/50
4,747,224 A * 5/1988 Smith ..... F41A 17/38 42/7
4,765,081 A * 8/1988 Dieringer ..... F41A 9/65 42/50
4,831,761 A * 5/1989 Kulakow ..... F41A 9/67 42/50
4,876,813 A * 10/1989 Tuma ..... F41A 9/70 42/50
4,888,899 A * 12/1989 Chesnut ..... F41A 9/70 42/50
4,936,037 A * 6/1990 Holcomb ..... F41A 9/65 340/539.1
4,970,818 A * 11/1990 Vecchieschi ..... F41A 9/66 42/50
5,056,252 A 10/1991 Velezis
5,099,595 A * 3/1992 Chesnut ..... F41A 9/69 42/50
5,293,708 A * 3/1994 Strayer ..... F41A 9/70 42/7
5,357,703 A * 10/1994 Chesnut ..... F41A 17/38 42/50
5,386,657 A * 2/1995 Racheli ..... F41A 9/69 42/50
5,388,360 A * 2/1995 Fortunato ..... F41A 9/70 42/50
5,438,783 A * 8/1995 Sniezak ..... F41A 9/65 42/50
5,507,110 A * 4/1996 Chesnut ..... F41A 9/65 42/50
5,568,696 A * 10/1996 Mauch ..... F41A 9/71 42/49.02
5,704,148 A * 1/1998 Valorose ..... F41A 9/65 42/49.02
5,755,052 A * 5/1998 Keeney ..... F41A 9/65 42/50
6,055,758 A * 5/2000 Vieweg ..... F41A 9/65 42/7
7,536,816 B2 * 5/2009 Weinberger ..... F41A 9/62 42/1.02
8,061,255 B1 * 11/2011 Boberg ..... F41A 15/14 89/33.1
8,225,541 B2 * 7/2012 Bigley ..... F41A 9/70 42/49.01
8,448,364 B2 * 5/2013 Davidson ..... F41A 9/69 42/50
8,561,334 B2 * 10/2013 Metzger ..... F41A 17/38 42/7
8,689,475 B2 * 4/2014 Battaglia ..... F41A 9/65 42/49.02
8,713,835 B1 * 5/2014 Calvert ..... F41A 9/71 42/49.02
9,279,631 B2 * 3/2016 Barnhart ..... F41A 9/67
9,347,721 B2 * 5/2016 Larson, Jr. ..... F41A 9/69
10,317,153 B2 * 6/2019 Faifer ..... F41A 9/71
10,480,880 B2 * 11/2019 Thomele ..... F41A 9/65
10,619,959 B1 * 4/2020 Loveday, IV ..... F41A 9/69
10,648,753 B1 * 5/2020 Jarratt ..... F41A 9/70
2002/0029506 A1 * 3/2002 Wollmann ..... F41A 9/65 42/50
2003/0046850 A1 * 3/2003 Beretta ..... F41A 9/65 42/50
2004/0200110 A1 * 10/2004 Greenhut ..... F41A 9/69 42/18
2006/0096145 A1 * 5/2006 Gussalli Beretta ..... F41A 17/38 42/50
2007/0089598 A1 4/2007 Courty
2008/0028661 A1 * 2/2008 Bubits ..... F41A 9/71 42/49.01
2008/0190003 A1 * 8/2008 Bolen ..... F41A 9/61 42/50
2008/0196290 A1 * 8/2008 Bubits ..... F42B 39/002 42/49.01
2011/0167694 A1 * 7/2011 Bigley ..... F41A 9/70 42/50
2012/0066950 A1 * 3/2012 Davidson ..... F41A 9/69 42/50
2012/0131831 A1 * 5/2012 Sullivan ..... F41A 9/65 42/50
2013/0227870 A1 * 9/2013 Rendulic ..... F41A 9/65 42/50
2013/0247437 A1 * 9/2013 Obermeit ..... F41A 9/69 42/49.01
2014/0150315 A1 * 6/2014 Russell ..... F41A 9/65 42/50
2015/0192377 A1 * 7/2015 Larson, Jr. ..... F41A 9/65 42/50
2016/0076841 A1 * 3/2016 Ballard ..... F41A 9/65 42/50
2016/0123688 A1 * 5/2016 Faifer ..... F41A 9/65 42/50
2016/0348991 A1 * 12/2016 Tisone ..... F41A 9/59
2018/0031342 A1 * 2/2018 Faifer ..... F41A 9/70
2018/0094886 A1 * 4/2018 Corso ..... F41A 9/70
2018/0120047 A1 * 5/2018 Righi ..... F41A 9/61
2019/0033022 A1 * 1/2019 Henninger ..... F41A 35/06
2019/0033023 A1 * 1/2019 Shipley ..... F41A 15/00
2019/0162496 A1 * 5/2019 Hogan, Jr. ..... F41A 9/69

(56) References Cited

U.S. PATENT DOCUMENTS

| | | | | |
|---|---|---|---|---|
| 2019/0195584 | A1* | 6/2019 | Thomele | F41A 9/70 |
| 2019/0339035 | A1* | 11/2019 | Coombs | F41A 9/69 |
| 2020/0025533 | A1* | 1/2020 | Shipley | F41A 9/75 |
| 2020/0056852 | A1* | 2/2020 | Thomele | F41A 9/70 |
| 2020/0064092 | A1* | 2/2020 | Pini | F41A 9/65 |
| 2020/0256630 | A1* | 8/2020 | Rosenblum | F41A 9/51 |

* cited by examiner

MAGAZINE OF A PISTOL FOR CARTRIDGES WITH A CASE RIM, AND PISTOL HAVING SUCH A MAGAZINE

BACKGROUND OF THE INVENTION

1. Field of the Invention

The invention relates to a magazine of a pistol for cartridges with a case rim, having a magazine body which is formed from two side walls, a front wall, and rear wall, and is intended for accommodating the cartridges in two rows, which are guided in a displaceable manner in the magazine body, a base plate, a feeder, and at least one compression spring between the feeder and the base plate, wherein the upper end region of the magazine body forms a narrowing, in which the two rows of cartridges are guided together.

2. Description of Related Art

Cartridges with a case rim, in particular .22LR caliber cartridges or .22 Magnum cartridges, are very common in shooting sports. It is often also the case with these cartridges that the firing means thereof is accommodated on the rim, rather than in the center of the case base.

The case rim has a larger diameter than the cartridge. This makes it considerably more difficult for the cartridges to be nested in the magazine. It is therefore usually the general design for magazines to have only a single row of cartridges, and the capacity generally being limited to 8 to 12 cartridges.

A magazine made of plastics material for the .22 Magnum cartridge is known in practice, the cartridges being guided up to the magazine lips in two rows which are separated from one another by a partition wall. The disadvantage is the unreliable feed of the cartridges into the cartridge chamber of the barrel, since a cartridge is fed alternately from the one row and the other. It is also necessary, as a result, to increase the overall width of the pistol, in particular of the grip. It is therefore also the case that virtually all pistols of other calibers are equipped with magazines which narrow in the upward direction.

SUMMARY OF THE INVENTION

Bearing in mind the problems and deficiencies of the prior art, it is therefore an object of the present invention to provide a magazine which is intended in a first embodiment for cartridges with a case rim, and makes it possible nevertheless for the cartridges to be accommodated in two rows, to be guided together in the direction of the magazine lips and to be introduced reliably into the cartridge chamber. This means that the number of cartridges accommodated could effectively double in comparison with the single-row arrangement.

It is another object of the present invention to provide a pistol having the aforementioned magazine.

The above and other objects, which will be apparent to those skilled in the art, are achieved in the present invention which is directed to a magazine for cartridges and a method of feeding cartridges into a magazine.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-12 of the drawings in which like numerals refer to like features of the invention.

Presented in a magazine are first beads, which form the lateral guidance for the cartridges. The side walls of the magazine are spaced apart from one another by a somewhat greater distance than the diameter of the cartridge, in order to make space for the case rims. The first beads, converging at a small angle at the magazine top, unite the two rows of cartridges into a single row. However, due to the fact that the side walls of the magazine do not converge, the case rims still have enough clearance in order to adapt in position. The convex bearing surface of the feeder makes it possible for all the cartridges, right up to the uppermost cartridge, to adjust their inclination. This provides for satisfactory interaction of the cartridges with the driving element of the slide.

An optimum value for the two angles has been found to range from 35 to 40 and 15 to 20 degrees, respectively, and preferably to be 40 and 18 degrees, respectively.

In an advantageous development, in front of the magazine lips, the side walls have guide lugs. These improve the lateral guidance of the cartridge when the latter is pushed into the cartridge chamber of the barrel.

An expedient development consists in the bearing surface of the feeder being provided with a transverse inclination, as a result of which even the lowermost cartridges of the two rows have a predetermined height offset. This makes it easier for the two rows of cartridges to be guided together at the upper end.

An advantageous practical embodiment consists in use being made of two compression springs of circular outline in plan view instead of a single compression spring of virtually rectangular outline in plan view. This does not just improve the guidance of the feeder; it also lowers the production costs, because such springs are cost-effective.

Two further beads in front of and behind the first bead serve to prevent the compression springs from buckling.

Figure 1:
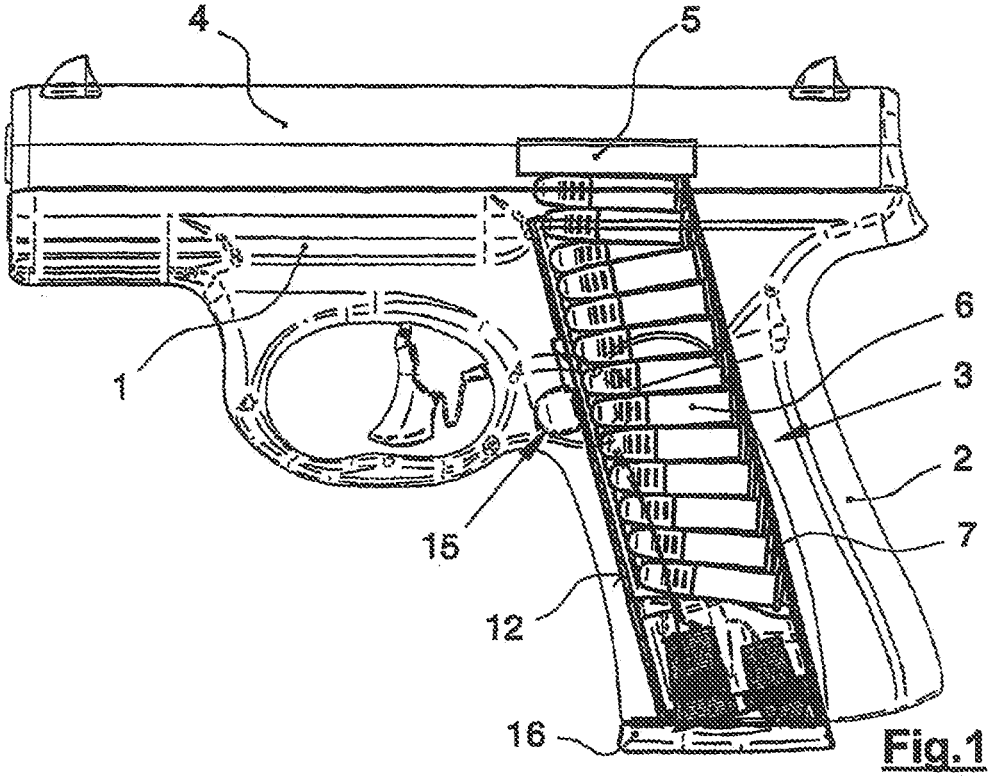
FIG. 1 illustrates a view of a pistol having the magazine according to the invention.

FIG. 1 indicates a pistol merely by way of its housing 1 with a grip 2 and by way of the slide 4 with a driving element 5. A well for the magazine 3 is formed in the grip 2. The magazine 3 holds a plurality of cartridges 6 with a case rim 7, of which the diameter is greater than that of the cartridge 6. The magazine 3 can be pushed into the grip 2 from beneath and is fixed by means of a locking device 15.

Figure 2:
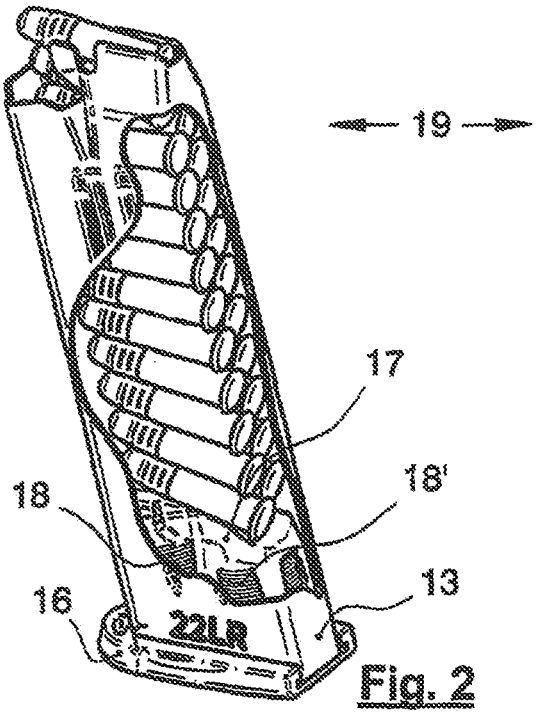
FIG. 2 illustrates an axonometric view of the magazine, part of it cut away.
Figure 3:
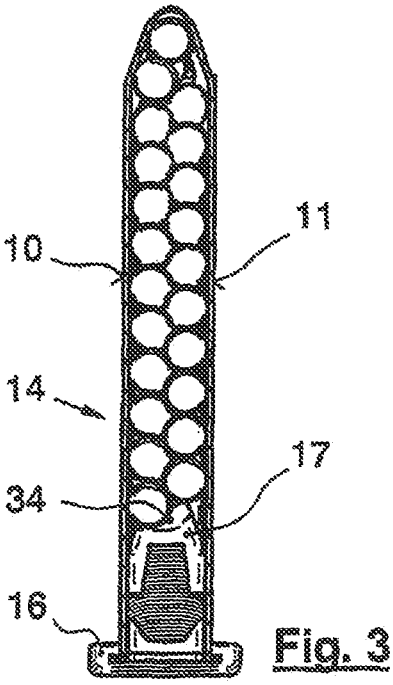
FIG. 3 illustrates a view of the magazine of FIG. 2 from behind.

FIGS. 2 and 3 depict different views of magazine 3. FIG. 3 depicts a view of magazine 3 from the rear end, showing magazine 3 forming a hollow, elongate magazine body 14, terminated on the bottom end by a base plate 16. Magazine 3 further includes a feeder 17 therein, and (referring to FIG. 2) two compression springs 18, 18' between feeder 17 and base plate 16. The magazine body 14 has an essentially rectangular cross section and is formed by two side walls 10, 11, an end wall 12 and a rear wall 13. The magazine body 14 accommodates the cartridges 6 in two vertically offset rows which are guided together in a narrowing 19 at the upper end to form a single cartridge row.

The direction-related information here and in the patent claims relates to the pistol held in the shooting direction by the shooter.

Figure 4:
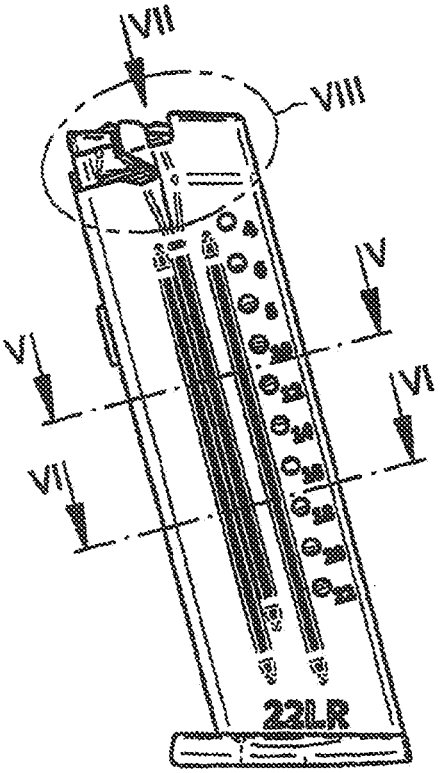
FIG. 4 illustrates a side view of the magazine.

FIG. 4 depicts a side view of magazine 3, and serves merely for the assignment of the following FIGS. 5-10.

Figure 5:
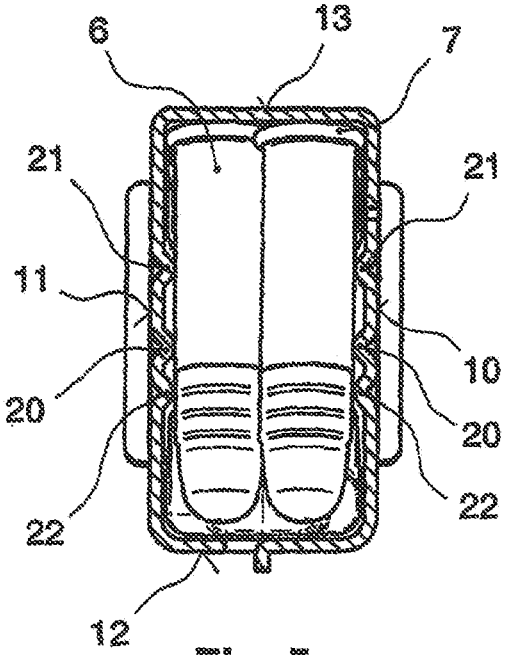
FIG. 5 illustrates a section taken along V-V in FIG. 4.

In FIG. 5, the cross section is taken through the magazine 3 above the feeder 17. FIG. 5 shows the cartridges 6 in two rows offset in the vertical direction in relation to one another. It can be seen that the cartridge is guided by first, inwardly directed beads 20 in the side walls 10, 11. The inside width between the side walls 10, 11 is greater than a cartridge diameter, in order to make space for the projecting case rims 7.

Figure 6:
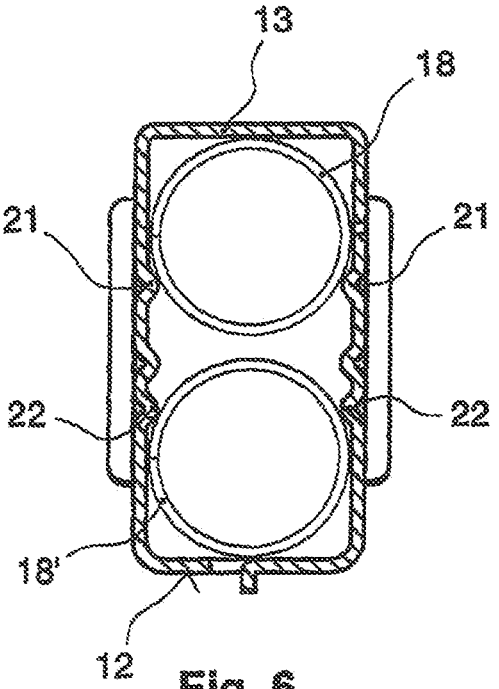
FIG. 6 illustrates a section taken along VI-VI in FIG. 4.

In FIG. 6, the cross section is taken through the magazine 3 beneath the feeder 17. The compression springs 18, 18', each with a circular outline in plan view, act on the feeder. Two further pairs of second beads 21, 22 serve here for guiding the compression springs 18, 18' and thus for preventing lateral buckling of the same.

Figure 7:
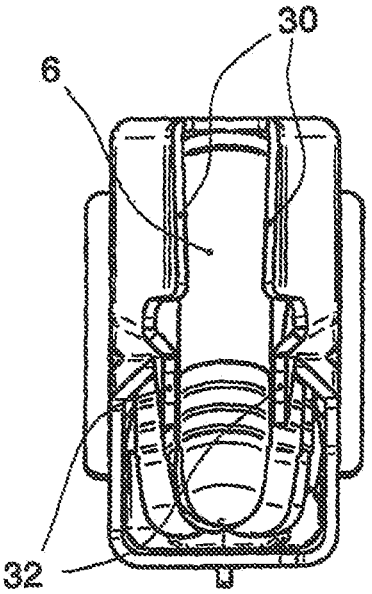
FIG. 7 illustrates a plan view in accordance with VII in FIG. 4.
Figure 8:
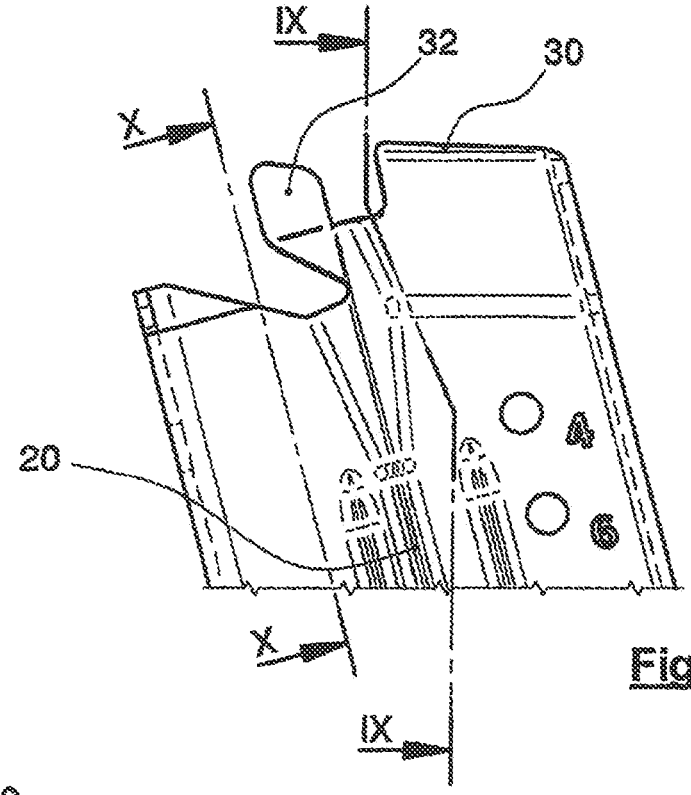
FIG. 8 illustrates detail VIII in FIG. 4.

FIGS. 7 and 8 show the narrowing 19 of the magazine body 14 in the upper end region, in which the side walls 10, 11 (FIG. 5) form inwardly inclined end parts 23, 24 (FIG. 9) and, by way of their upper rim, magazine lips 30. The latter hold a respective cartridge 6 ready in order to be pushed by the driving element 5 into the cartridge chamber (not illustrated) of the barrel. Guide lugs 32, which are arranged in front of the magazine lips, ensure here that the cartridge is fed in a centered manner.

Figure 9:
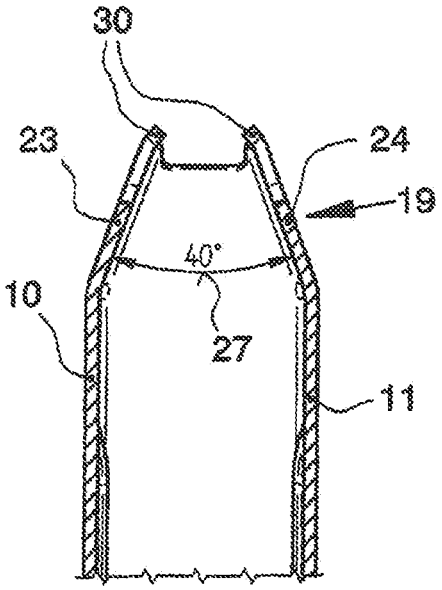
FIG. 9 illustrates a section taken along IX-IX in FIG. 8.
Figure 10:
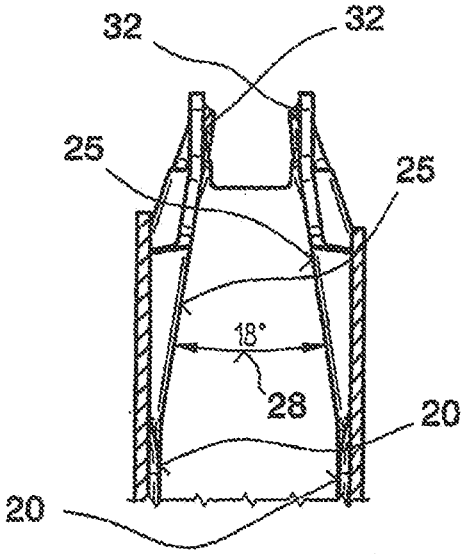
FIG. 10 illustrates a section taken along X-X in FIG. 8.

The design of the narrowing 19 (FIGS. 2 and 3) accords alignment of the cartridges for the driving element. The narrowing guides two vertically offset rows of cartridges together towards the presentation of a single cartridge at the top of the magazine, and at driving element 5. FIGS. 9 and 10 depict the narrowing effect.

According to FIG. 9, the end parts of the side walls 23, 24 are inclined inward about a first angle 27. The first beads 20 (FIGS. 5 and 10) are recessed in the region of the narrowing 19 and form guide ribs 25 (FIG. 10) which are inclined inward about a second angle 28. The second angle 28 is approximately half the size of the first angle 27, and the guide ribs 25 therefore extend further downward. As a result, the cartridges of the two rows are guided one above the other by the guide ribs 25 on account of the small second angle 28, the case rims of the cartridges still having sufficient freedom of movement between the side walls 10, 11 and, only at a later stage, between the end parts of the side walls 23, 24, the end parts being inclined at the first angle 27.

Figure 11:
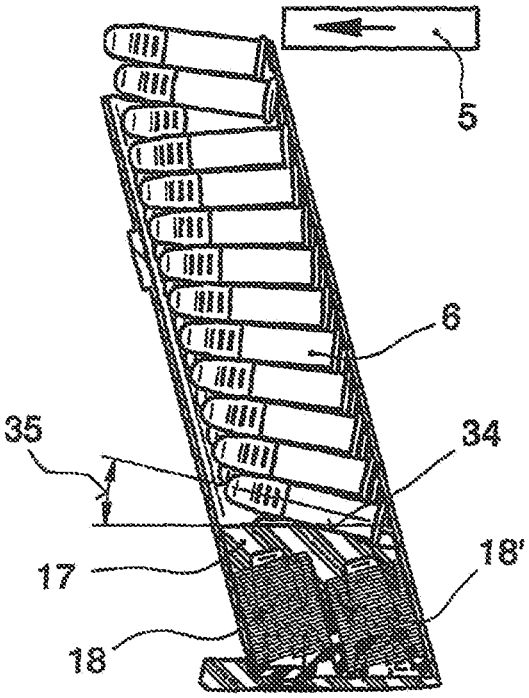
FIG. 11 illustrates the magazine in a first position.
Figure 12:
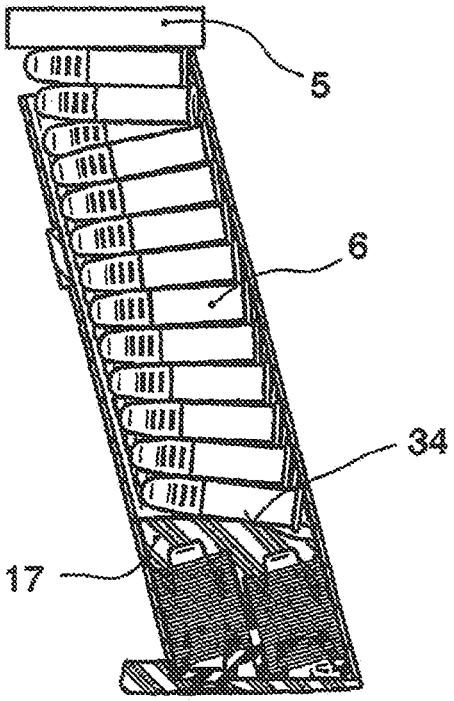
FIG. 12 illustrates the magazine in a second position.

FIGS. 11 and 12 depict the feeder 17 in the magazine. Feeder 17 includes a bearing surface 34 which is curved convexly along the feeder's longitudinal direction (the direction of the pistol's barrel). This makes it possible for the cartridges 6 of both rows to position their angle of inclination 35 in relation to the horizontal in dependence on the current positioning of the driving element 5 of the breech.

In FIG. 11, driving element 5 is located in the rear position, before it pushes the upwardly inclined, uppermost cartridge into the cartridge chamber.

In FIG. 12, the driving element 5 is in the foremost position, the uppermost cartridge butting against driving element 5 and being approximately horizontal. By virtue of the convexly curved bearing surface 34, all the cartridges right down as far as the feeder 17 can position themselves correspondingly. It is also the case that the bearing surface 34 of feeder 17, as can be seen in FIG. 3, is inclined in the transverse direction in a manner corresponding to the vertical offset of the two rows of cartridges.

In a magazine which is designed according to the invention for .22LR caliber cartridges, the first angle 27 (FIG. 9) is depicted as 40°—and preferably ranges between 35° and 50°—and the second angle 28 (FIG. 10) is 18 degrees—and preferably ranges between 15° and 20°.

The magazine of the present invention further defines a method for feeding cartridges to a firearm. The method steps include: a) loading an elongated passage of the magazine with a plurality of cartridges, each cartridge having a case rim, wherein the magazine has sidewalls that form an elongated passage having an interior width less than a total combined width of two side-by-side cartridges; b) vertically offsetting the plurality of cartridges by placing the cartridges on an inclined surface of a feeder, the feeder inclined surface being inclined in a transverse direction approximately perpendicular to the longitudinal direction such that a vertical offset of the plurality of cartridges is formed; c) guiding the plurality of cartridges upwards in the elongated passage from a lower position to a higher position in the magazine using the feeder under spring compression; d) forming a single row of cartridges at a top portion of the magazine using magazine body side walls having top inclined portions, inclined inwardly about a first angle, forming feed lips at the top portion of the magazine such that two vertically offset rows of the plurality of cartridges are guided together by the feed lips to form a single row; e) inclining the plurality of cartridges at an angle of inclination to position a cartridge located on the feeder at an angle relative to the horizontal; f) positioning a topmost cartridge for reception by a driving element of the firearm; and g) presenting a new topmost cartridge to the driving element after a previous topmost cartridge has been received by the driving element.

LIST OF REFERENCE SIGNS

1 Housing
2 Grip
3 Magazine
4 Slide
5 Driving element
6 Cartridge
7 Case rim
10 Left-hand side wall
11 Right-hand side wall
12 End wall
13 Rear wall
14 Magazine body
15 Magazine lock
16 Base plate
17 Feeder
18, 18' Compression springs
19 Narrowing
20 First beads

21 Second beads
22 Further beads
23 Left-hand side wall inclined
24 Right-hand side wall inclined
25 First bead inclined, guide rib
27 First angle
28 Second angle
30 Magazine lips
32 Guide lugs
34 Bearing surface of 17
35 Angle of inclination of 6

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A magazine for cartridges, said magazine comprising:

a hollow magazine body having side walls extending in a longitudinal direction at an angle from a horizontal plane, an end wall, a rear wall, and a base plate having a bottom surface in said horizontal plane, said magazine body having a length and an upper end region forming a narrowing portion guiding together two vertically offset rows of cartridges to form a single row;

a feeder guided in said magazine body having a bearing surface and an opposing bottom surface, said bearing surface being convex in said longitudinal direction and altering an angle of inclination of a cartridge located thereon in relation to the horizontal plane;

compression springs between said feeder and said base plate and said compression springs seat within said opposing bottom surface, said compression springs applying force to said feeder in an upward direction towards said magazine upper end region, and extending predominantly the length of said magazine in said upward direction;

said magazine body side walls including top inclined portions, inclined inwardly about a first angle forming magazine lips which enclose an uppermost cartridge centrally, said side walls including inwardly directed, first beads which run over a length of said side walls and merge in the upper region into converging guide ribs, wherein inner edges of said first beads run inward at a second angle, which is smaller than said first angle, and second beads located on a lower portion of said magazine body side walls serving to guide said circular compression springs and prevent lateral buckling thereof.

2. The magazine of claim 1, wherein said first angle is in the range of 35 to 50 degrees.

3. The magazine of claim 1, wherein said second angle is in the range of 15 and 20 degrees.

4. The magazine of claim 1 including guide lugs on said side walls, located adjacent said magazine lips.

5. The magazine of claim 1, wherein said bearing surface of said feeder is inclined in a transverse direction, approximately perpendicular to said longitudinal direction, forming a vertical offset for two rows of cartridges such that said two rows of cartridges are offset vertically in relation to one another.

6. The magazine of claim 1, including two cylindrical compression springs arranged one behind another between said feeder and the base plate, and situated within a bottom surface of said feeder.

7. The magazine of claim 1, wherein in front of and/or behind said first bead, each of said side walls has at least one further bead of constant depth.

* * * * *